US011198998B1

(12) United States Patent
Zung

(10) Patent No.: US 11,198,998 B1
(45) Date of Patent: Dec. 14, 2021

(54) SYSTEM AND METHOD FOR TRAPPING AND CONTAINING OBJECTS IN STORM SEWER

(71) Applicant: Thomas T. K. Zung, Bratenahl, OH (US)

(72) Inventor: Thomas T. K. Zung, Bratenahl, OH (US)

( * ) Notice: Subject to any disclaimer, the term of this patent is extended or adjusted under 35 U.S.C. 154(b) by 92 days.

(21) Appl. No.: 16/882,970

(22) Filed: May 26, 2020

Related U.S. Application Data

(60) Provisional application No. 62/873,695, filed on Jul. 12, 2019.

(51) Int. Cl.
*E03F 5/14* (2006.01)

(52) U.S. Cl.
CPC ..... *E03F 5/14* (2013.01)

(58) Field of Classification Search
CPC ... E03F 5/0404; E03F 5/14; E03F 1/00; E03F 5/106; E03F 1/001; B01D 29/27; B01D 35/02; C02F 2103/001
USPC ..... 210/170.03, 460
See application file for complete search history.

(56) References Cited

U.S. PATENT DOCUMENTS 2,102,310 A * 12/1937 Egan ..... E03F 5/0401 210/497.3
2003/0183569 A1* 10/2003 Hannah ..... B01D 29/27 210/236
2014/0374332 A1* 12/2014 Hannah ..... E03F 5/14 210/170.03

* cited by examiner

*Primary Examiner* — Claire A Norris
(74) *Attorney, Agent, or Firm* — Michael A. Bondi; Moss & Barnett

(57) ABSTRACT

A system for trapping and containing objects in a storm sewer that includes a liner, a collection portion and a base portion. The liner having a port. The collection portion is adapted to receive the liner. The base portion is adapted to receive at least a part of the collection portion. The base portion is mountable in a body of water. The base portion includes a port for attachment to a storm sewer pipe. When the part of the collection portion is received in the base portion, the liner port is in communication with the base portion port.

20 Claims, 8 Drawing Sheets

SYSTEM AND METHOD FOR TRAPPING AND CONTAINING OBJECTS IN STORM SEWER

REFERENCE TO RELATED APPLICATION

This application claims priority to U.S. Applic. No. 62/873,695, which was filed on Jul. 12, 2019. The contents of which are incorporated herein by reference.

FIELD OF THE INVENTION

The invention relates generally to a system and method for removing garbage from a storm sewer. More particularly, the invention relates to a system and method for trapping and containing objects in a storm sewer.

BACKGROUND OF THE INVENTION

Storm sewers collect and remove excess water such as from rain or melting snow and thereby reduce the risk of flooding. It is customary in many areas to discharge the water from the storm sewer into a body of water such as a river, lake or ocean.

Frequently, objects, such as bottles and cans, enter the storm sewer and are carried away with the storm sewer water. These objects enter the body of water into which the storm sewer water is discharged and thereby degrade the quality of the body of water.

SUMMARY OF THE INVENTION

An embodiment of the invention is directed to a system for trapping and containing objects in a storm sewer that includes a liner, a collection portion and a base portion. The liner has a port. The collection portion is adapted to receive the liner. The base portion is adapted to receive at least a part of the collection portion. The base portion is mountable in a body of water. The base portion includes a port for attachment to a storm sewer pipe. When the part of the collection portion is received in the base portion, the liner port is in communication with the base portion port.

Another embodiment of the invention is direct to a method of trapping and containing objects in a storm sewer. A base portion is placed in a body of water. The base portion includes a port. The base portion port is operably attached to a storm sewer pipe. A liner is positioned in a collection portion. The liner includes a port. At least a part of a collection portion is positioned in the base portion so that the base portion port is proximate the liner port. Storm water and objects flow through the storm sewer pipe and into the liner. The objects are contained in the liner while allowing the water to flow through the liner.

Another embodiment of the invention is directed to a system for trapping and containing objects in a storm sewer that includes a liner, a collection portion and a base portion. The liner has a port. The liner is fabricated from a material that allows water to flow through the liner. The collection portion is adapted to receive the liner. The collection portion includes a bottom wall that is movable between an open configuration and a closed configuration. When the bottom wall is in the closed configuration, the liner is retained in the collection portion. The base portion has a recess formed therein that is adapted to receive at least a part of the collection portion. The recess has a size and shape that are similar to a size and shape of the part of the collection portion that is received in the base portion. The base portion includes a port for attachment to a storm sewer pipe. When the part of the collection portion is received in the base portion, the liner port is in communication with the base portion port.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE INVENTION

Figure 1:
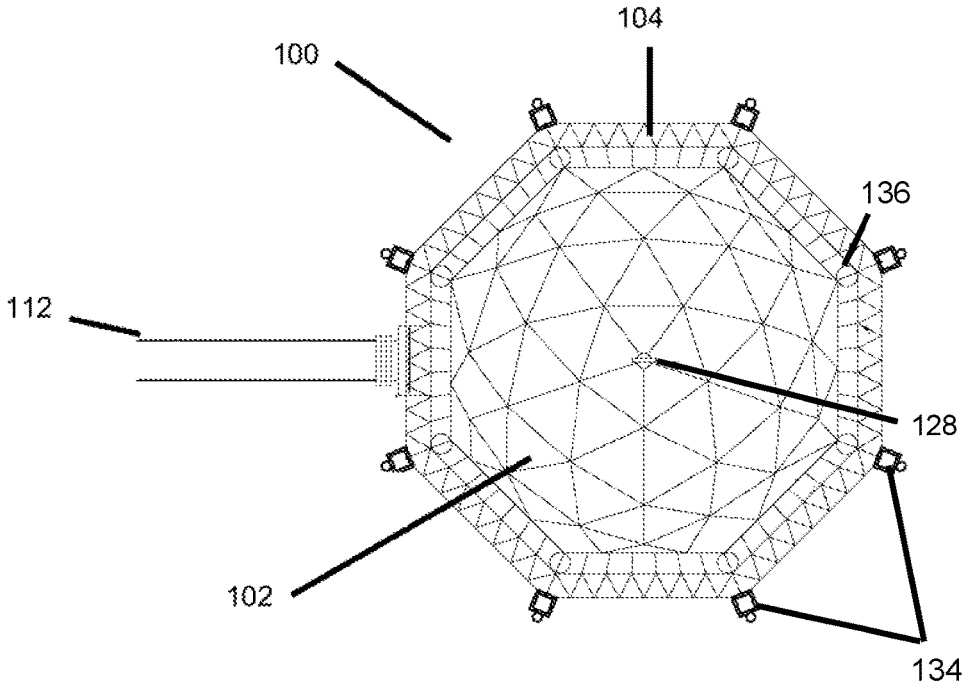
FIG. 1 is a plan view of a system for trapping and containing objects in a storm sewer according to an embodiment of the invention.
Figure 2:
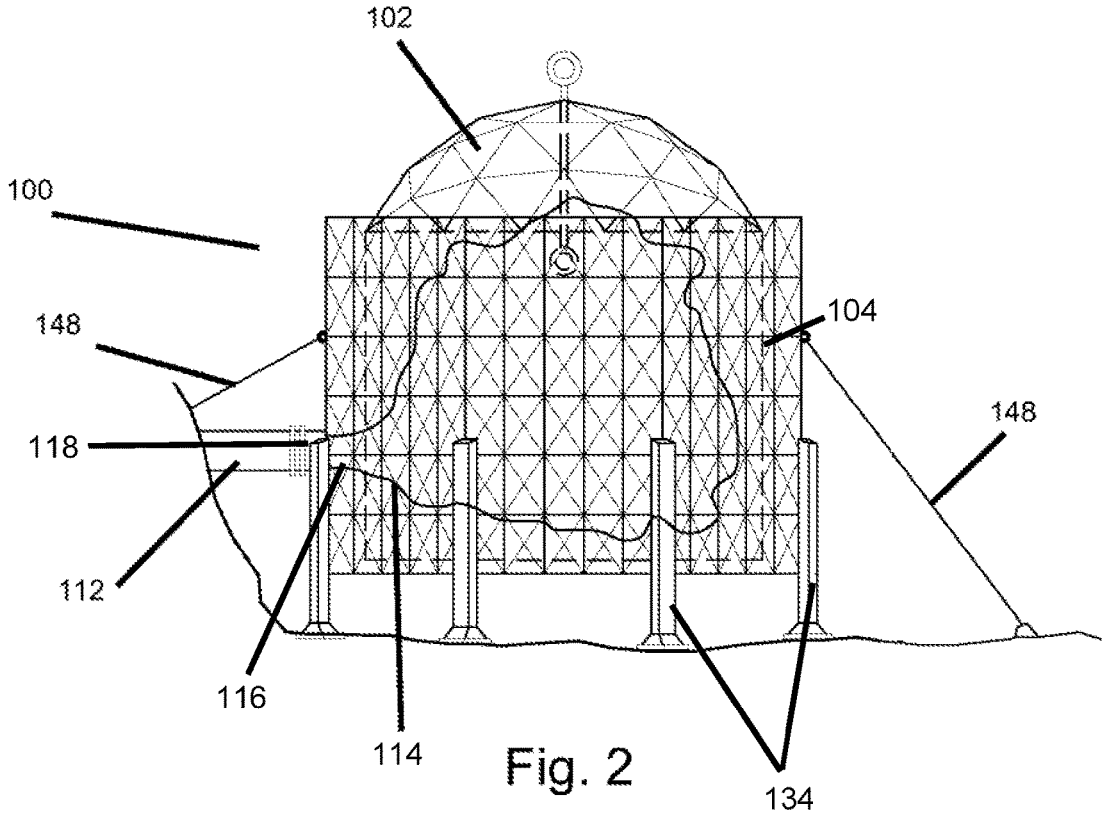
FIG. 2 is an elevation view of the system for trapping and containing objects in the storm sewer.

An embodiment of the invention is directed to a system for trapping and containing objects in a storm sewer at illustrated at 100 in the figures. The system for trapping and containing objects in a storm sewer 100 generally includes a collection portion 102 and a base portion 104 as illustrated in FIGS. 1 and 2.

The base portion 104 is mounted in a body of water 110 proximate to a storm sewer discharge 112. The collection portion 102 is mounted with respect to the base portion 104 so that water and objects flowing through the storm sewer 112 are collected in a liner 114 inside of the collection portion 102. The water flows through the liner 114 but the objects are trapped and contained in the liner 114, as is discussed in more detail herein.

The collection portion 102 may have a variety of shapes using the concepts of the invention. However, the collection portion 102 should have sufficient rigidity to not deform as the objects are trapped and contained in the liner 114 as well as when the collection portion 102 is lifted out of the body of water to empty the liner 114 that is filled with the trapped and contained objects.

Figure 3:
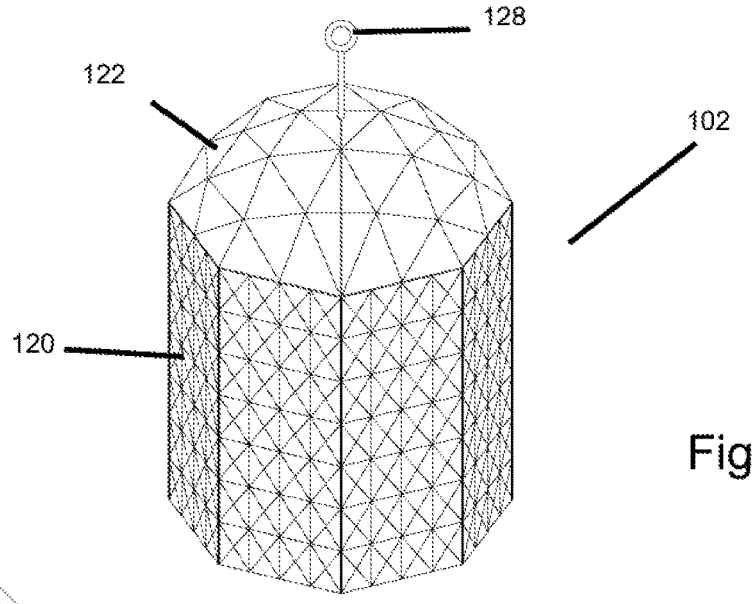
FIG. 3 is an isometric view of a collection portion of the system for trapping and containing objects in the storm sewer.
Figure 5:
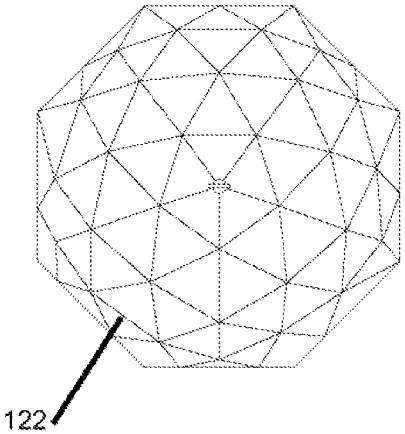
FIG. 5 is an elevation view of the collection portion.
Figure 4:
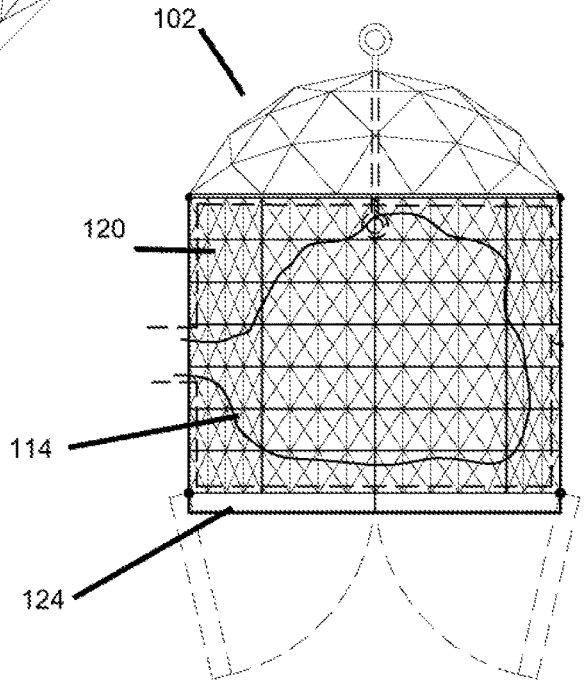
FIG. 4 is a top plan of the collection portion.

In certain embodiments, the collection portion 102 is defined by a side wall 120, a top wall 122 and a bottom wall 124, as most clearly illustrated in FIGS. 3-5. The side wall 120 extends substantially around the collection portion 102. The side wall 120 may have a variety of configurations using the embodiments of the invention. In certain embodiments, the side wall 120 has a generally octagonal shape. The side wall 120 may be fabricated from a plurality of elongated frame elements that are arranged in an array. Using such a configuration provides the side wall 120 with rigidity to resist deformation and allows the water to flow therethrough.

The top wall 122 may substantially enclose an upper end of the side wall 120. In certain embodiments, the top wall 122 has a convex shape as illustrated in FIGS. 3-5. In other embodiments, at least a portion of the top wall 122 has a geodesic shape. This configuration enhances the strength of the top wall 12 to facilitate lifting of the collection portion 102 when the liner 114 is filled with the collected objects and needs to be emptied. Similar to the side wall 120, the top wall 122 may be fabricated from a plurality of elongated frame elements that are arranged in an array. Using such a configuration provides the top wall 122 with rigidity to resist deformation and allows the water to flow therethrough.

The bottom wall 124 may substantially enclose a lower end of the side wall 120. In certain embodiments, the bottom wall 124 is movable between a closed configuration that retains the liner 114 inside of the collection portion 102 and an open configuration where the liner 114 can be discharged from the lower end of the collection portion 102 such as into a garbage truck as is described in more detail herein.

In one configuration, the bottom wall 124 has two sections that pivot away from each other when moving to the open configuration as illustrated by the dotted lines in FIG. 4. A locking mechanism (not shown) may be used to retain the bottom wall 124 in the closed configuration.

The liner 114 includes a port 116 through which the water and objects can flow from the storm drain pipe 112. When the collection portion 102 is positioned in the base portion 104, the liner port 116 is positioned proximate the base portion port 118. In certain embodiments, the base portion port 118 may extend into the liner port 116. Because of the nature of the underwater use of the invention, it is not necessary for a watertight seal to be formed between the liner port 116 and the base portion port 118.

The collection portion 102 may include a mount that holds the liner port 116 in a position within the collection portion 102. Alternatively, the structure of the liner 114 may hold the liner port 116 in a desired position within the collection portion 102.

The liner 114 is fabricated from a material that allows water to flow therethrough but is sufficiently strong to resist damage while the objects are being collected in the liner 114. A person of skill in the art will appreciate that a variety of materials having the preceding characteristics may be used. The liner 114 may be fabricated with a shape and a size that are similar to the interior shape and size of the collection portion 102.

The collection portion 102 may have a stem portion 128 that extends therefrom. In certain embodiments, the stem portion 128 extends from the top wall 126. The stem portion 128 facilitates lifting of the collection portion 102 such as using the crane as is described in more detail herein. In one configuration, the stem portion 128 has a circular opening.

The base portion 104 may be configured to at least partially receive the collection portion 102 as illustrated in FIGS. 1 and 2. In certain embodiments, the base portion 104 has a recess formed therein that is adapted to receive the collection portion 102.

Figure 7:
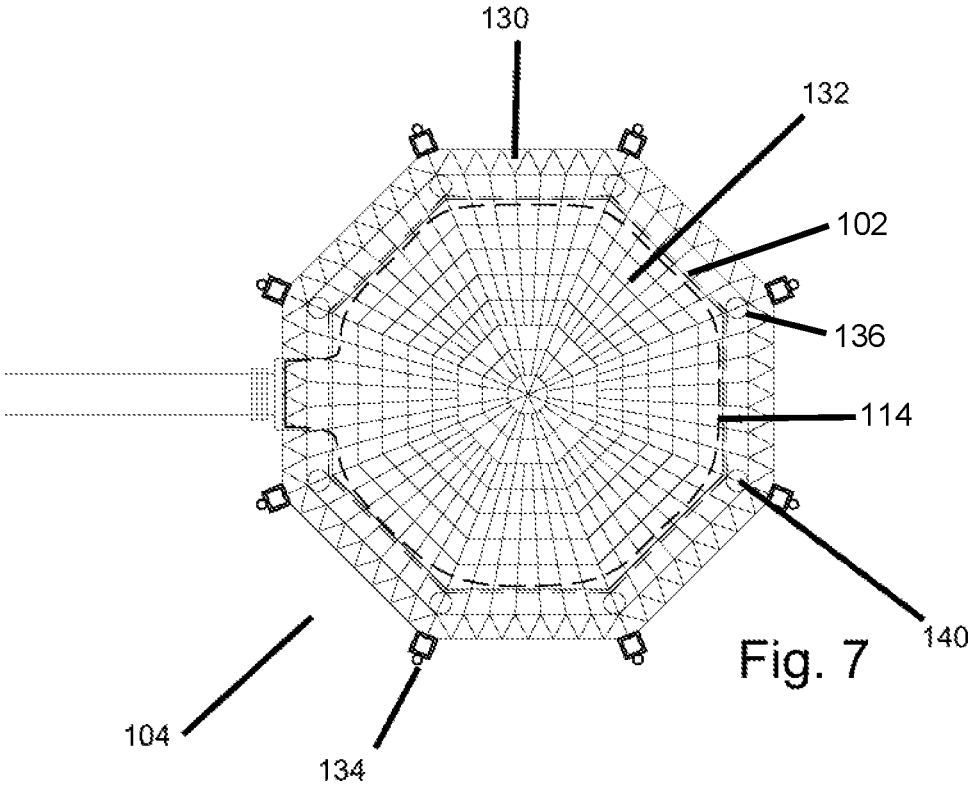
FIG. 7 is a top plan view of the base portion.
Figure 6:
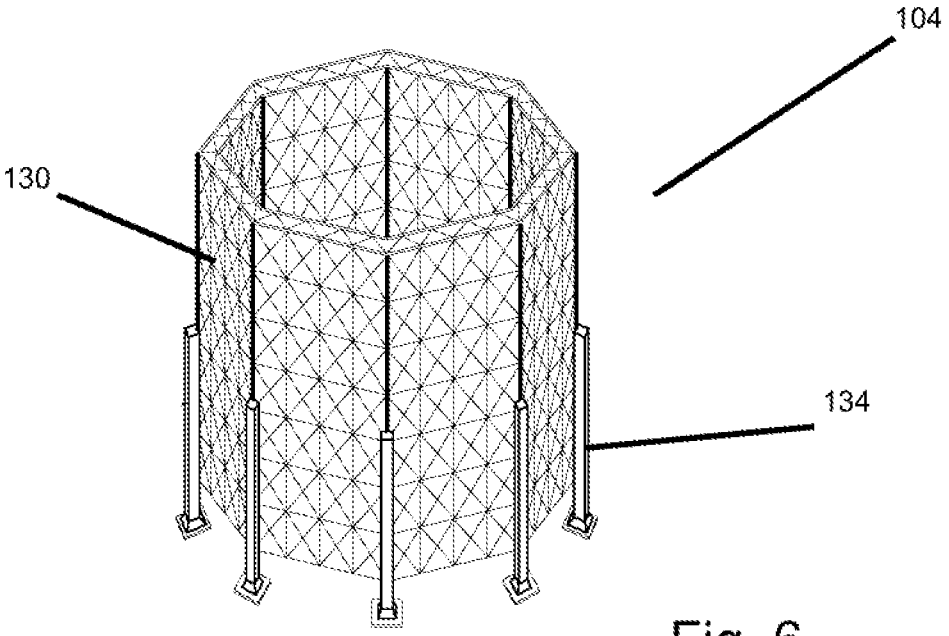
FIG. 6 is an isometric view of a base portion of the system for trapping and containing objects in the storm sewer.

The base portion 104 generally includes a side wall 130 and a bottom wall 132 as illustrated in FIGS. 6 and 7. In certain embodiments, the side wall 130 has a shape and a size that are similar to the shape and the side of the side wall 120. The side wall 130 may be fabricated from a plurality of elongated frame elements that are arranged in an array. Using such a configuration provides the side wall 130 with rigidity to resist deformation and allows the water to flow therethrough.

The bottom wall 132 may substantially enclose a lower end of the side wall 130. Similar to the side wall 130, the top wall 132 may be fabricated from a plurality of elongated frame elements that are arranged in an array. Using such a configuration provides the bottom wall 132 with rigidity to resist deformation and allows the water to flow therethrough.

The base portion 104 may include at least one bumper 140 on an inner surface thereof that facilitates guiding the collection portion 102 into the base portion 104 as well as limiting movement of the collection portion 102 with respect to the base portion 104 after the collection portion 102 is inserted into the base portion 104.

A variety of mechanisms may be used to attach the storm sewer pipe 112 with respect to the base portion 104 to substantially restrict movement of the base portion 104 with respect to the storm sewer pipe 112.

As illustrated in FIG. 2, the base portion 104 may be anchored with respect to the surface at the bottom of the body of water using a variety of techniques. One such technique utilizes at least one cable, wire or rope 148 that extends from the base portion 104 and is anchored to the surface at the bottom of the body of water. This anchoring process substantially prevents the base portion 104 from moving with respect to the storm sewer pipe 112.

The base portion 104 may include a plurality of legs 134 that are operably attached thereto. The legs 134 enable adjusting a distance between the base portion 104 and the bottom surface of the body of water in which the base portion 104 is mounted. Such adjustment facilitates positioning of the base portion 104 with respect to the storm sewer pipe 112.

The number and size of the legs 134 may be selected based upon a variety of factors such as the width and height of the base portion 104 and the weight of objects that are intended to be collected in the liner 114.

At least one of the base portion 104 and the collection portion 102 may include at least one bumper 136. In certain embodiments, the bumpers 136 are fabricated from a resilient material and a positioned proximate each of the corners of the base portion 104 or the collection portion 102. The bumpers 136 thereby facilitate accurate placement of the collection portion 102 with respect to the base portion 104.

In operation, the system for trapping and containing objects in the storm sewer 100 may be fabricated at a location away from the location where the system 100 is intended to be installed. Thereafter, the system for trapping and containing objects in the storm sewer 100 is transported to the location for installation on a transport vehicle 150 as illustrated in FIG. 8.

Figure 8:
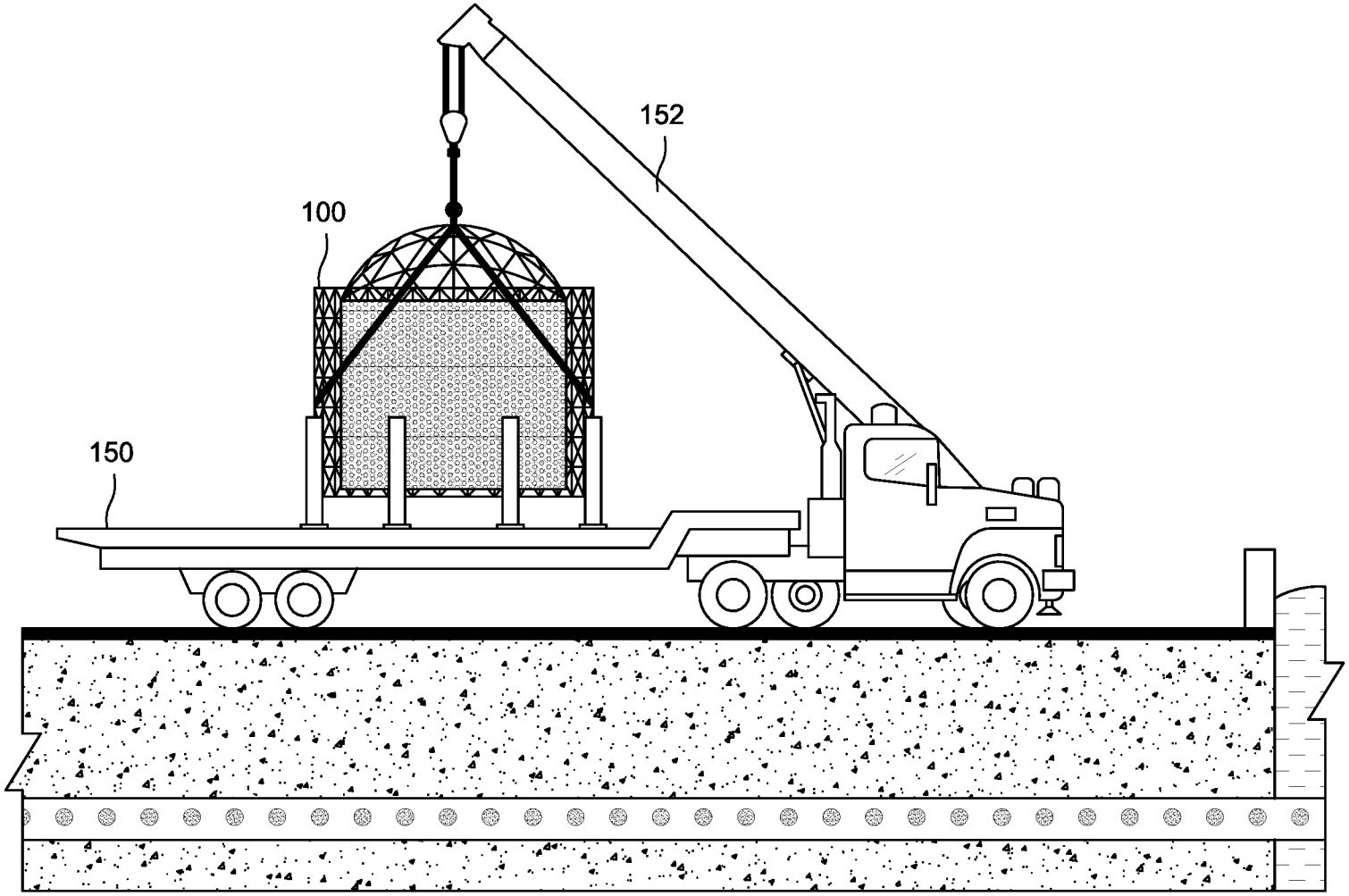
FIG. 8 is a side view of the system for trapping and containing objects in the storm sewer being lifted off a transport vehicle with a crane.
Figure 9:
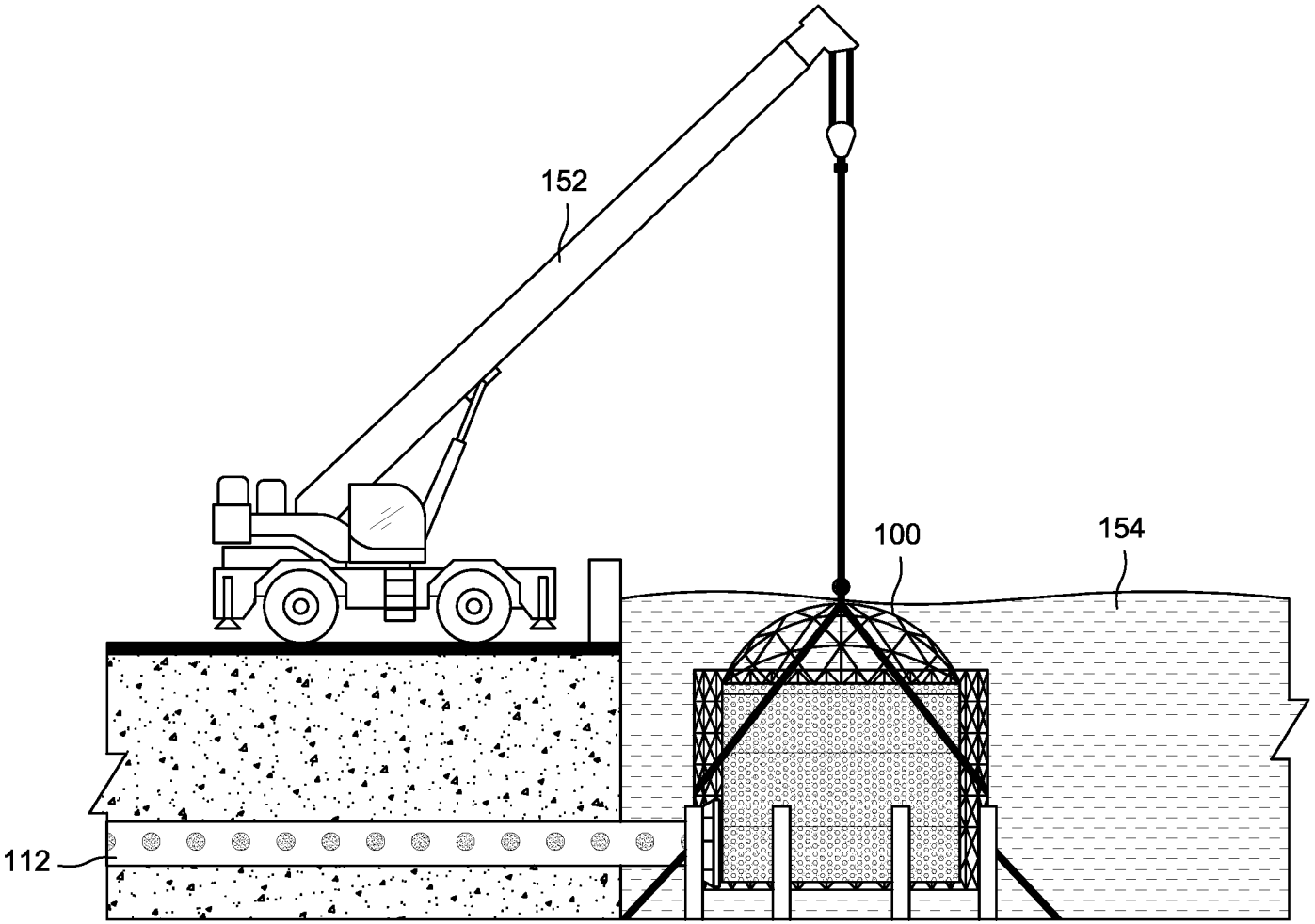
FIG. 9 is a side view of the system for trapping and containing objects in the storm sewer being lowered by the crane into a body of water proximate to a storm sewer discharge.

A crane 152 is used to lift the system for trapping and containing objects in the storm sewer 100, as illustrated in FIG. 8. The crane 152 then lowers the system for trapping and containing objects in the storm sewer 100 into a body of water 154 proximate the storm sewer pipe 112, as illustrated in FIG. 9.

The legs 134 are adjusted so that the base portion 104 is as a desired location with respect to the storm sewer pipe 112. Thereafter, the base portion 104 is anchored to the surface at the bottom of the body of water 154 with the cable 148, as illustrated in FIG. 9.

Figure 10:
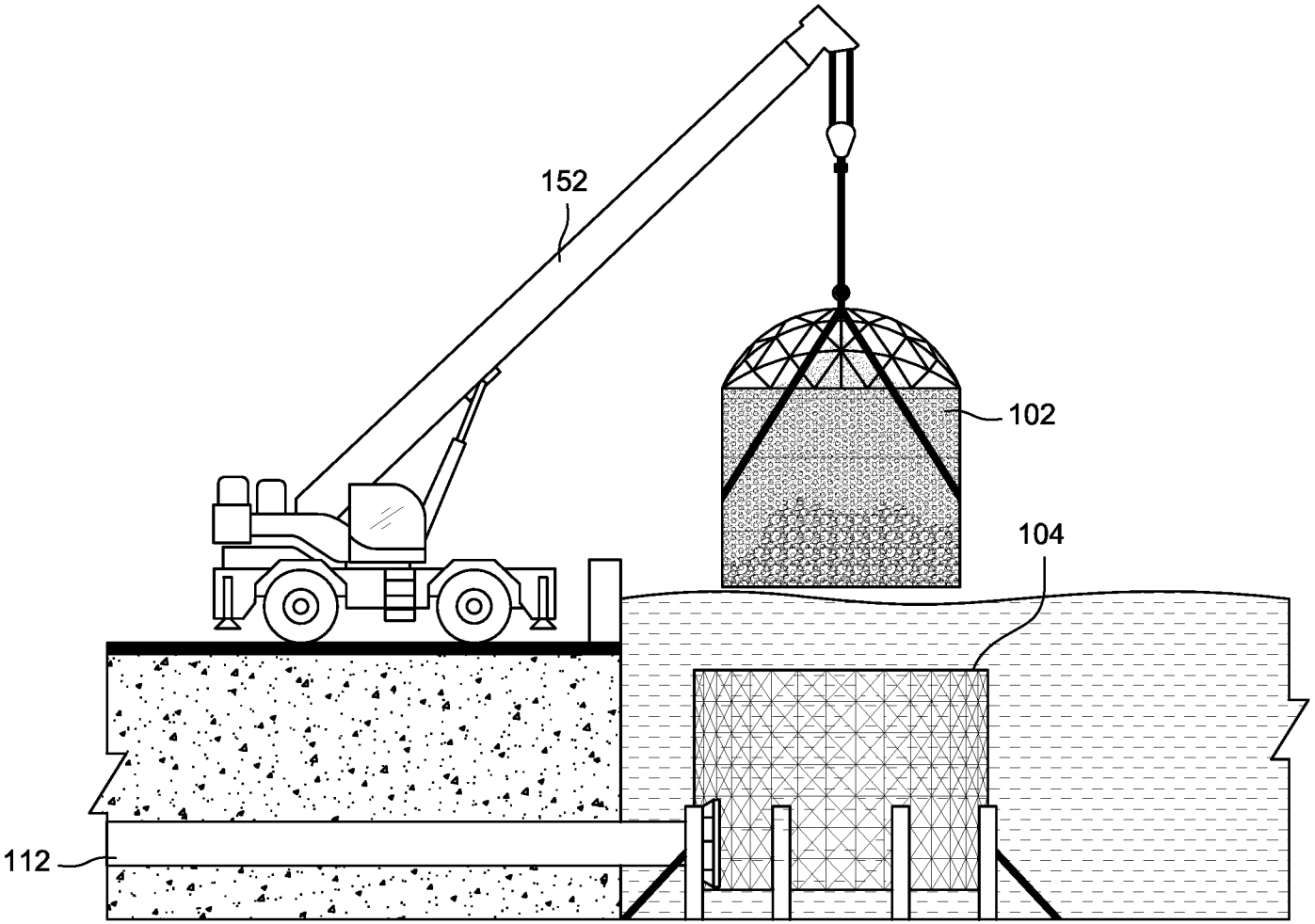
FIG. 10 is a side view of the collection portion being raised with the crane.

As the water and objects flow through the storm sewer pipe 112 and into the liner 114, the water flows through the liner 114 and the objects are trapped and contained in the liner 114. When the liner 114 is filled to a desired extent with the objects, the crane 152 lifts the collection portion 102 from the water as illustrated in FIG. 10.

Figure 11:
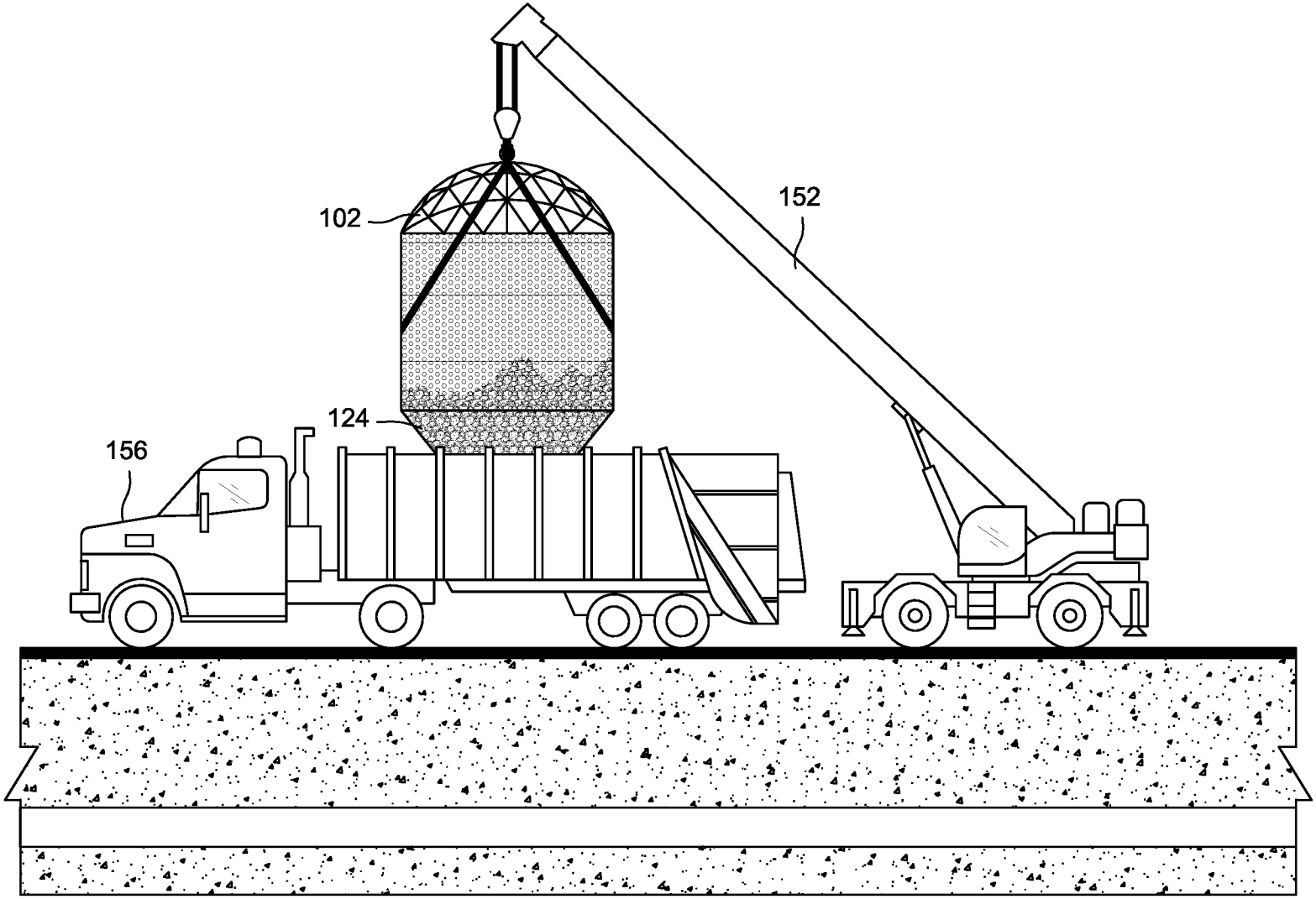
FIG. 11 is a side view of the collection portion being emptied into a garbage truck.

The bottom wall 124 on the collection portion 102 is opened to allow the liner 114 and the objects trapped therein to be discharged into a garbage truck 156 or other collection device, as illustrated in FIG. 11. Thereafter, the objects are disposed of in an appropriate manner.

Figure 12:
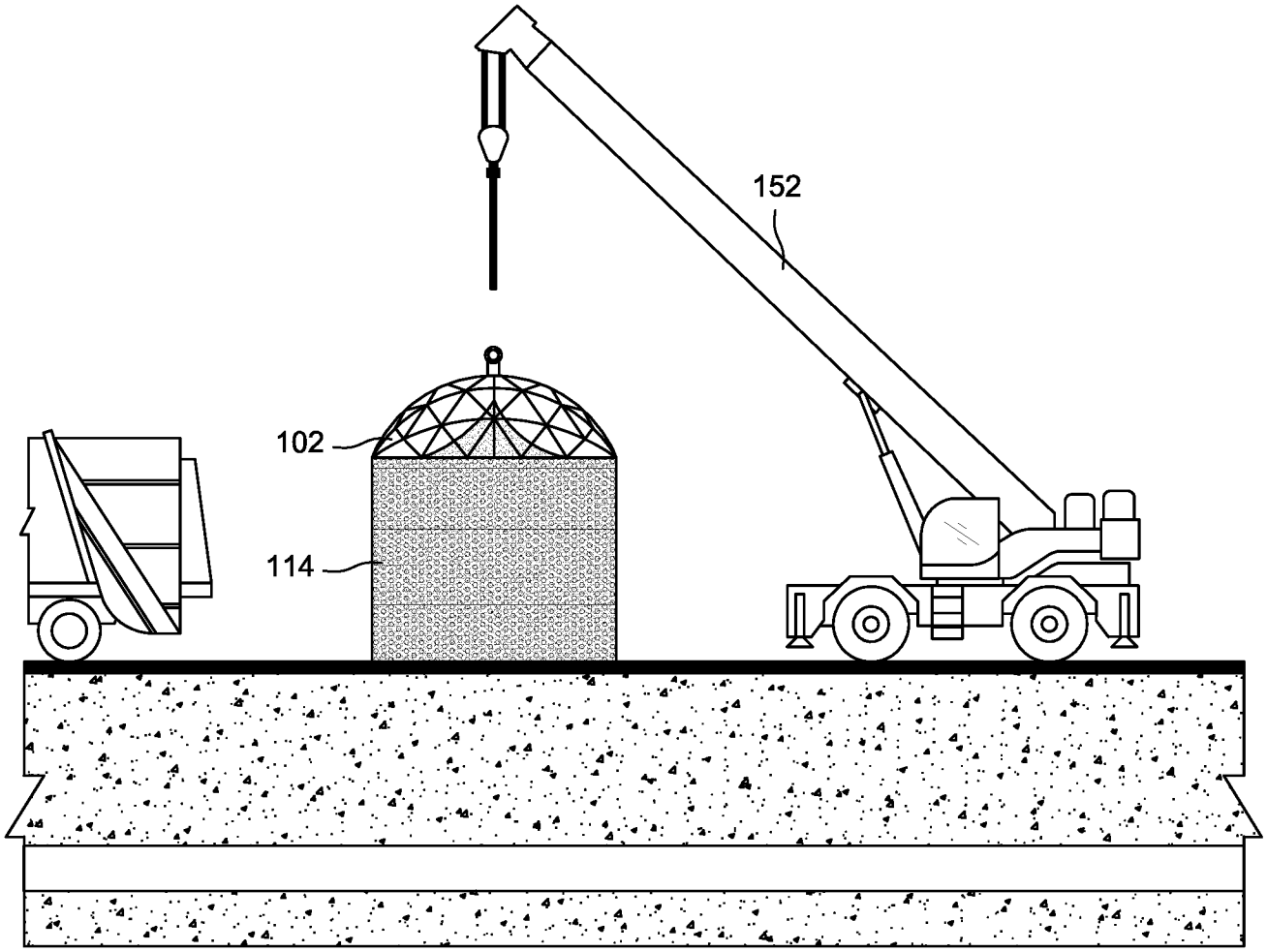
FIG. 12 is a side view of a liner being placed in the collection portion.

Next, another liner 114 is placed in the collection portion 102, as illustrated in FIG. 12, and the crane 152 places the collection portion 102 into the base portion 104 so that additional objects can be trapped and contained in the system.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A system for trapping and containing objects in a storm sewer comprising:

a liner having a port;

a collection portion that is adapted to receive the liner;

a base portion that is adapted to receive at least a part of the collection portion, wherein the base portion is mountable in a body of water, wherein the base portion includes a port for attachment to a storm sewer pipe and wherein when the part of the collection portion is received in the base portion, the liner port is in communication with the base portion port.

2. The system of claim 1, wherein the collection portion comprises a side wall, a top wall and a bottom wall, wherein the side wall is attached to and extends between the top wall and the bottom wall to define an enclosure and wherein the enclosure is adapted to receive the liner.

3. The system of claim 1, wherein the collection portion comprises a bottom wall that is movable between an open configuration and a closed configuration and wherein when the bottom wall is in the closed configuration, the liner is retained in the collection portion.

4. The system of claim 1, wherein the collection portion further comprises a stem attached thereto for lifting the collection portion.

5. The system of claim 1, wherein the collection portion comprises a top wall and wherein the top wall has a geodesic shape.

6. The system of claim 1, wherein the base portion has a recess formed therein that is adapted to receive the part of the collection portion and wherein the recess has a size and shape that are similar to a size and shape of the part of the collection portion that is received in the base portion.

7. The system of claim 1, wherein the base portion further comprises:

at least one leg operably attached thereto for supporting the base portion in the body of water; and an anchor for restricting movement of the base portion in the body of water.

8. The system of claim 1, wherein the liner is fabricated from a material that allows water to flow through the liner.

9. The system of claim 1, wherein at least one of the collection portion and the base portion includes a plurality of bumpers attached thereto and wherein the plurality of bumpers guide the part of the collection portion into the base portion.

10. A method of trapping and containing objects in a storm sewer comprising:

placing a base portion in a body of water, wherein the base portion includes a port;

operably attaching the base portion port to a storm sewer pipe;

positioning a liner in a collection portion, wherein the liner includes a port;

positioning at least a part of a collection portion in the base portion so that the base portion port is proximate the liner port;

flowing storm water and objects through the storm sewer pipe and into the liner; and containing the objects in the liner while allowing the water to flow through the liner.

11. The method of claim 10, and further comprising:

lifting the collection portion out of the body of water;

discharging the liner with the objects contained therein from the collection portion;

placing another liner in the collection portion; and positioning the part of the collection portion into the base portion.

12. The method of claim 11, wherein the lifting the collection portion and positioning the part of the collection portion into the base portion is done using a crane.

13. The method of claim 12, wherein the collection portion further comprises a stem attached thereto and wherein the crane attaches to the stem when lifting the collection portion and positioning the at least the part of the collection portion into the base.

14. The method of claim 11, wherein the collection portion comprises a bottom wall that is movable between an open configuration and a closed configuration and wherein the discharging the liner with the objects contained therein comprises moving the bottom wall from the closed configuration to the open configuration.

15. The method of claim 10, and further comprising positioning the base portion with respect to the storm sewer pipe using at least one leg operably attached to the base portion.

16. The method of claim 10, and further comprising anchoring the base portion in the body of water.

17. The method of claim 10, wherein the base portion has a recess formed therein that is adapted to receive the part of the collection portion, wherein the recess has a size and shape that are similar to a size and shape of the part of the collection portion that is received in the base portion and wherein the method further comprises guiding the part of the collection portion into the base portion with a plurality of bumpers attached to at least one of the collection portion and the base portion.

18. A system for trapping and containing objects in a storm sewer comprising:

a liner having a port, wherein the liner is fabricated from a material that allows water to flow through the liner;

a collection portion that is adapted to receive the liner, wherein the collection portion comprises a bottom wall that is movable between an open configuration and a closed configuration and wherein when the bottom wall is in the closed configuration, the liner is retained in the collection portion;

a base portion having a recess formed therein that is adapted to receive at least a part of the collection portion, wherein the recess has a size and shape that are similar to a size and shape of the part of the collection portion that is received in the base portion, wherein the base portion is mountable in a body of water and wherein when the part of the collection portion is received in the base portion, the liner port is in communication with the base portion port.

19. The system of claim 18, wherein the collection portion further comprises a stem attached thereto for lifting the collection portion and wherein the system further comprises a crane for lifting the collection portion out of the base portion recess.

20. The system of claim 18, wherein the base portion further comprises at least one leg operably attached thereto for supporting the base portion in the body of water and wherein the system further comprises an anchor for restricting movement of the base portion in the body of water.

* * * * *